US009022473B2

(12) United States Patent
Crum

(10) Patent No.: US 9,022,473 B2
(45) Date of Patent: May 5, 2015

(54) ROCKER RECLINER MECHANISM WITH CHANGEABLE FEATURES

(71) Applicant: L & P Property Management Company, South Gate, CA (US)

(72) Inventor: Michael A. Crum, Mantachie, MS (US)

(73) Assignee: L&P Property Management Company, South Gate, CA (US)

( * ) Notice: Subject to any disclaimer, the term of this patent is extended or adjusted under 35 U.S.C. 154(b) by 189 days.

(21) Appl. No.: 13/875,934

(22) Filed: May 2, 2013

(65) Prior Publication Data

US 2014/0327282 A1 Nov. 6, 2014

(51) Int. Cl.

| | |
|---|---|
| ***A47C 3/026*** | (2006.01) |
| ***A47C 1/0355*** | (2013.01) |
| ***A47C 1/032*** | (2006.01) |
| ***A47C 3/02*** | (2006.01) |
| ***A47C 7/02*** | (2006.01) |
| ***A47C 7/54*** | (2006.01) |

(52) U.S. Cl.

CPC . *A47C 1/032* (2013.01); *A47C 3/02* (2013.01); *A47C 7/02* (2013.01); *A47C 7/54* (2013.01); *A47C 3/026* (2013.01); *A47C 1/0355* (2013.01)

(58) Field of Classification Search

CPC ..... A47C 3/026; A47C 1/0355
USPC ..... 297/85 R, 85 L, 259.1, 259.2
See application file for complete search history.

(56) References Cited

U.S. PATENT DOCUMENTS

| | | | |
|---|---|---|---|
| 2,532,025 | A | 11/1950 | Johnson |
| 3,122,396 | A | 2/1964 | Belisle et al. |
| 3,141,700 | A | 7/1964 | Fletcher |
| 4,004,836 | A | 1/1977 | Kristensson |
| 4,380,352 | A | 4/1983 | Diffrient |
| 4,477,118 | A | 10/1984 | Ruble |
| 4,854,641 | A | 8/1989 | Reineman et al. |
| 5,007,679 | A | 4/1991 | Mizelle |
| 5,803,545 | A | 9/1998 | Guguin |
| 6,540,291 | B2 | 4/2003 | Hoffman et al. |
| 6,619,742 | B1 | 9/2003 | Bellefleur |
| 7,410,215 | B2 | 8/2008 | Dehli |
| 7,475,944 | B2 | 1/2009 | Griepentrog et al. |

(Continued)

OTHER PUBLICATIONS

International Search Report with Written Opinion for PCT Patent Application No. PCT/US2014/036564, Mailed Date: Sep. 4, 2014, 13 Pages.

*Primary Examiner* — Anthony D Barfield
(74) *Attorney, Agent, or Firm* — Shook, Hardy & Bacon L.L.P.

(57) ABSTRACT

A rocker-type seating unit that includes a base for providing vertical support, a seat support, and a backrest support. The seating unit adjusts between an upright position and a reclined position. The seating unit includes a support frame, a seat assembly, and a rocker mechanism. The support frame includes lower crossbeams coupled to the base, and a traverse plate fixedly attached to and extends upward from the lower crossbeams. The seat assembly includes a seat frame for carrying the seat support over the support frame, seat-mounting plates fixedly attached to and extend downward from the seat frame, and an upper crossbeam that spans and couples the seat-mounting plates. The rocker mechanism is connected to the upper crossbeam on one end and connected to the traverse plate on another end. The interconnection of rocker mechanism enables a controlled, fore-and-aft sway of the seat assembly with respect to the support frame.

20 Claims, 13 Drawing Sheets

(56) References Cited

U.S. PATENT DOCUMENTS

| | | | | |
|---|---|---|---|---|
| 7,497,512 | B2 | 3/2009 | White et al. | |
| D601,359 | S | 10/2009 | Wold | |
| 7,669,921 | B2 | 3/2010 | Hoffman et al. | |
| 7,823,976 | B2 | 11/2010 | Mackert et al. | |
| D633,312 | S | 3/2011 | Wold | |
| 8,366,193 | B2 * | 2/2013 | Lin | 297/259.2 |
| 8,696,054 | B2 | 4/2014 | Crum | |
| 8,882,190 | B2 * | 11/2014 | Garland | 297/85 L |
| 2002/0149238 | A1 * | 10/2002 | Hoffman et al. | 297/85 |
| 2003/0015900 | A1 * | 1/2003 | Lu | 297/259.1 |
| 2011/0304193 | A1 | 12/2011 | Murphy et al. | |
| 2012/0112517 | A1 | 5/2012 | Hoffman et al. | |

* cited by examiner

ROCKER RECLINER MECHANISM WITH CHANGEABLE FEATURES

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a seating unit that acts as a rocker recliner. Accordingly, the improved linkage mechanism of the present invention provides for reclining the seating unit while accommodating operation of a rocker mechanism.

Reclining seating units exist that typically allow a user to forwardly extend a footrest or ottoman and to recline a backrest relative to a seat. These existing seating units typically provide three basic positions: a standard, non-reclined closed position; an extended position; and a reclined position. In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, often referred to as a television ("TV") position, the ottoman is extended forward of the seat, and the backrest remains sufficiently upright to permit comfortable television viewing by an occupant of the seating unit. In the reclined position the backrest is positioned rearward from the extended position into an obtuse relationship with the seat for lounging or sleeping.

Several existing rocker recliners presently in the industry are adapted to provide the adjustment capability described above. However, these existing rocker recliners require relatively complex linkage mechanisms to afford this capability. The complex linkage assemblies limit certain design aspects utilized by furniture manufacturers, such as the incorporation of a T-cushion as a seat support.

Further, these existing rocker recliners are outfitted with a set of coil springs (metal spring unit) that causes unfavorable movements when an occupant of an existing rocker recliner is attempting rock forward and rearward. Often, existing rocker recliners include a cam that facilitates the rocking motion, where a top of the set of coil springs attach to the cam and a bottom of the set of coil springs attach to a base that is resting on an underlying surface. When the cam rocks in an arc with respect to the base, the set of coil springs creates a counter-balance in pressure as some coil springs are compressed while others are extended. This counter-balance in pressure is a main contributing factor to the unfavorable rocking movements within the existing rocker recliners.

Accordingly, the present invention introduces a novel linkage mechanism that allows a rocker-recliner-style seating unit to provide various styling features to customers while, at the same time, provides an innovative and simplified rocker mechanism that generates favorable rocking movements.

BRIEF SUMMARY OF THE INVENTION

Accordingly, the present invention seeks to provide an improved seating product, which can be adapted to be integrated in essentially any type of seating unit, that allows certain features to be interchanged to create multiple functions and styling capabilities. In this way a common set of parts may be assembled to achieve a variety of configurations. Further the improved seating product introduces a simplified arrangement for a rocking chair without the need for coil springs. This simplified arrangement includes a compact rocking mechanism (see reference numeral 240) that is reduced in height as compared to conventional rocker-type seating units that require the cam and a set of coil springs. Thus, the rocking mechanism of the present invention allows many different features and styling options that are not available within conventional rocker-type seating units.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

Embodiments of the present invention seek to provide a simplified, compact, rocker mechanism which can fully adjust a rocker-type seating unit between two positions (upright and reclined) and two conditions (extended and closed) without limiting movement of the rocker mechanism. As used herein, the phrase "rocker mechanism" refers to one or more elements and/or an apparatus that allows a seat of the seating unit to sway or rock forward and backward with respect to a base (e.g., pedestal base).

Further, the compact configuration of the rocker mechanism allows for constructing the rocker recliner with certain features that may be interchanged to create multiple functions and styling capabilities. In embodiments, a discrete set of parts that comprises the rocker mechanism may be assembled in different ways to achieve the multiple functions and styling capabilities.

For example, armrests of the rocker recliner may be assembled in different ways to allow customers to specify varying arrangements of features and styling options while, at the same time, using the discrete set of parts during fabrication. In one instance (see FIG. 2), the armrests may be assembled to opposed ends of one or more upper crossbeams that are fixed to a seat assembly. In this arrangement, the armrests are attached to the seat, allowing for T-cushion seat styling and winged-back cushion styling. In another instance (see FIG. 1), the armrests may be assembled to opposed ends of one or more lower crossbeams that are fixed to a support frame. In this arrangement, the armrests are attached to the base, allowing legs to be attached to the armrests (see FIG. 3).

In another example, the simplistic design of the rocker mechanism allows the rocker recliner to be assembled in a modular manner. In one instance, the rocker recliner may be constructed with a footrest assembly that is coupled to a seat frame of the seat assembly (see FIGS. 4-7). In this instance, the rocker recliner is provided with an integrated footrest with extension and retraction capability. In another instance, the rocker recliner may be constructed without the footrest assembly (see FIGS. 1-3), yet with no significant change to the seat frame with respect to the embodiment having the footrest assembly installed. In this instance, the rocker recliner is absent the capability to extend and retract a footrest or ottoman.

In yet another example, the simplistic design of the rocker mechanism allows the rocker recliner to be assembled to a variety of bases. In one instance, a pedestal base may be assembled to the support frame (see FIGS. 1 and 2). In this arrangement, the support frame is adapted to swivel with respect to the pedestal base that rests on an underlying surface. In another instance, when the armrests are assembled to the support frame, legs may be fastened to the armrests (see FIG. 3). In this arrangement, the rocker recliner assumes a more conventional appearance and may be configured as a loveseat or couch.

BRIEF DESCRIPTION OF THE SEVERAL VIEWS OF THE DRAWING

Illustrative embodiments of the present invention are described in detail below with reference to the attached drawing figures, which are incorporated by reference herein. In the accompanying drawings, which form a part of the specification and which are to be read in conjunction therewith, and in which like reference numerals are used to indicate like parts in the various views.

DETAILED DESCRIPTION OF THE INVENTION

Figure 2:
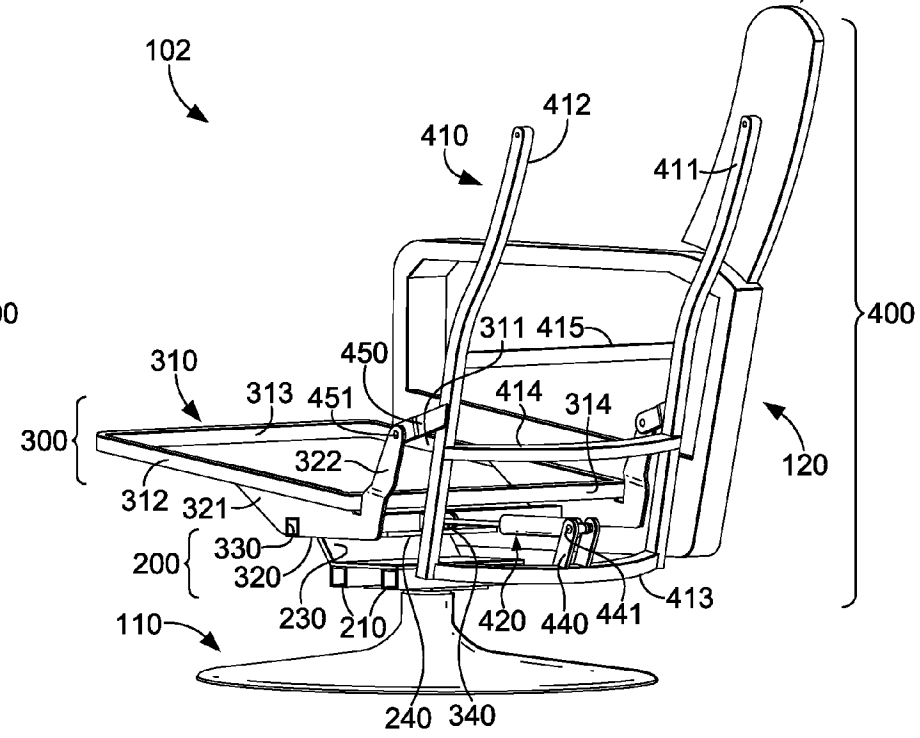
FIG. 2 is a perspective view of a seating unit in the upright position with one or more armrests assembled to a seat assembly and the pedestal base assembled to the support frame, in accordance with an embodiment of the present invention.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or varying components/materials similar to the ones described in this document, in conjunction with other present or future technologies.

Seating-Unit Components

Generally, embodiments of the present invention relate to a rocker-type seating unit (hereinafter the "seating unit" or "recliner," used interchangeably). Typically, the seating unit is equipped with a base, a seat support, and a backrest support. In operation, the seating unit is capable of moving between an upright position and a reclined position.

In an exemplary embodiment, the seating unit includes a rocker mechanism, a seat assembly, and a support frame, where the support frame further includes lower crossbeam(s) and a traverse plate. The lower crossbeam(s) are coupled to the base, which holds the support frame above an underlying surface. The traverse plate is fixedly attached to and extends upward from the lower crossbeam(s).

The seat assembly includes a seat frame, seat-mounting plates, and an upper crossbeam. The seat frame is configured to carry the seat support over the support frame. The seat-mounting plates are fixedly attached to and extend downward from the seat frame, and the upper crossbeam that spans and couples the seat-mounting plates. The rocker mechanism is connected to the upper crossbeam on a first end and connected to the traverse plate on the second end. The interconnection of rocker mechanism enables a controlled, fore-and-aft sway of the seat assembly with respect to the support frame.

In one embodiment, the seating unit may further include a footrest assembly that extends and retracts foot-support ottoman(s). Specifically, the footrest assembly is configured to extend the ottoman(s) to an extended condition and retract the ottoman(s) to a closed condition. Typically, the footrest assembly is pivotably coupled to a forward portion of the seat frame.

In another embodiment, the seating unit includes a backrest assembly that includes a backrest frame for carrying the backrest support over the support frame. In one instance, the backrest assembly is fixedly attached to the seat frame. In another instance, when the backrest assembly is pivotably coupled to a rearward portion of the seat frame, the backrest assembly reclines and inclines the backrest frame with respect to the seat assembly.

In yet another embodiment, the seating unit may include a pair of armrests. In one instance, the armrests may be fixedly attached to the opposed ends, respectively, of the lower crossbeam(s) (see FIG. 1). In this first arrangement the armrests remain motionless upon an occupant of the seating unit rocking the seat frame fore and aft with respect to the lower crossbeam(s) using the flexible elements. In another instance, the armrests are fixedly attached to the opposed ends, respectively, of the upper crossbeam (see FIG. 2). In this second configuration, the armrests sway upon the occupant of the seating unit rocking the seat frame fore and aft with respect to the lower crossbeam(s) using the flexible elements.

It should be noted that embodiments of the present invention relate broadly to seating units designed to support a user's body in an essentially seated disposition. As utilized herein, the phrase "seating units" is not meant to be limiting, but relates broadly to apparatuses designed to support a user's body in an essentially seated disposition. By way of example, a seating unit may generally refer to recliners, incliners, sofas, love seats, sectionals, office furniture, theater seating, traditional chairs, automotive seating, motion or stationary residential seating, chairs with a moveable seat portion, and any other seating systems know by those in the relevant field.

Figure 5:
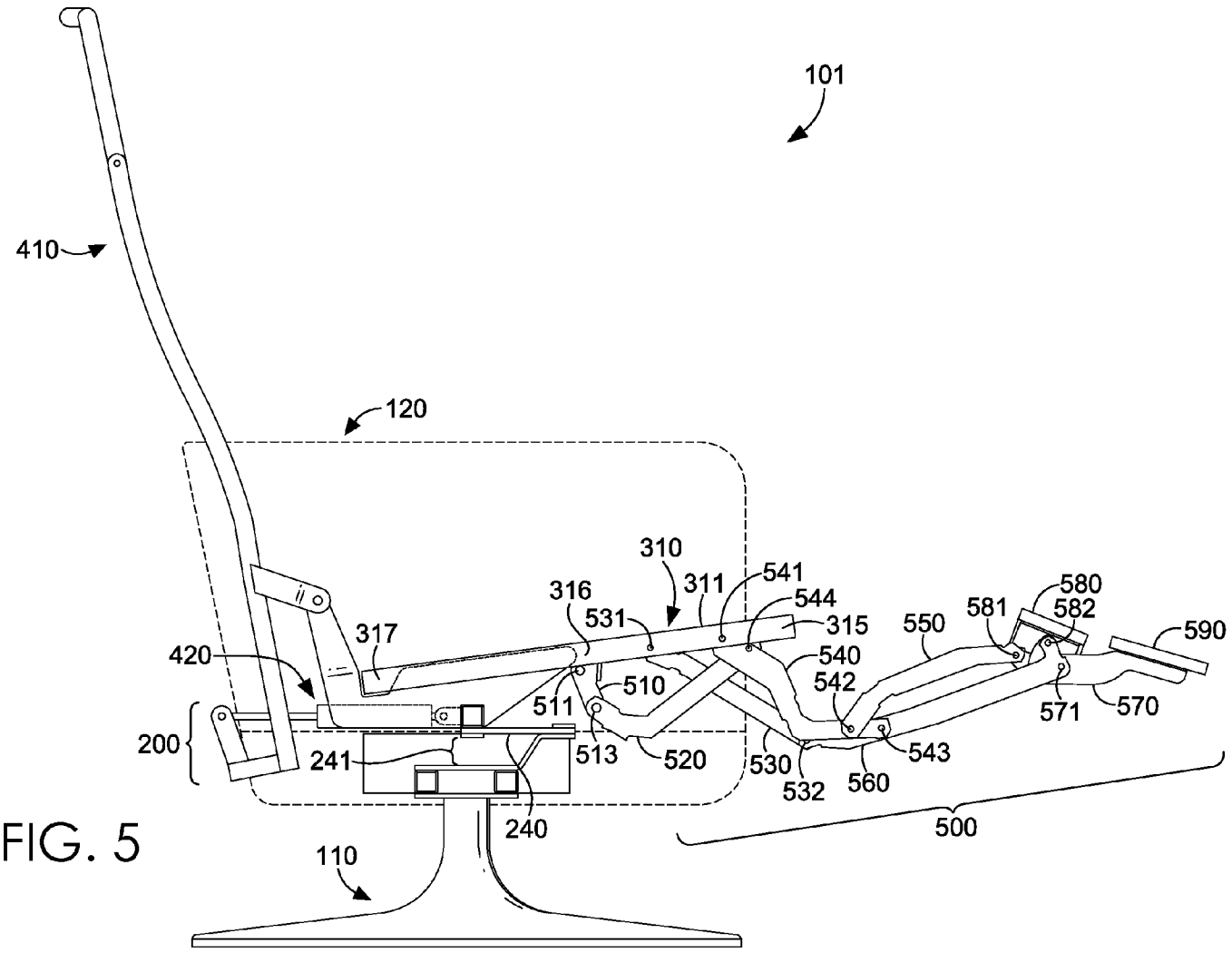
FIG. 5 is a view similar to FIG. 4, but in the upright position and in an extended condition, in accordance with an embodiment of the present invention.
Figure 8:
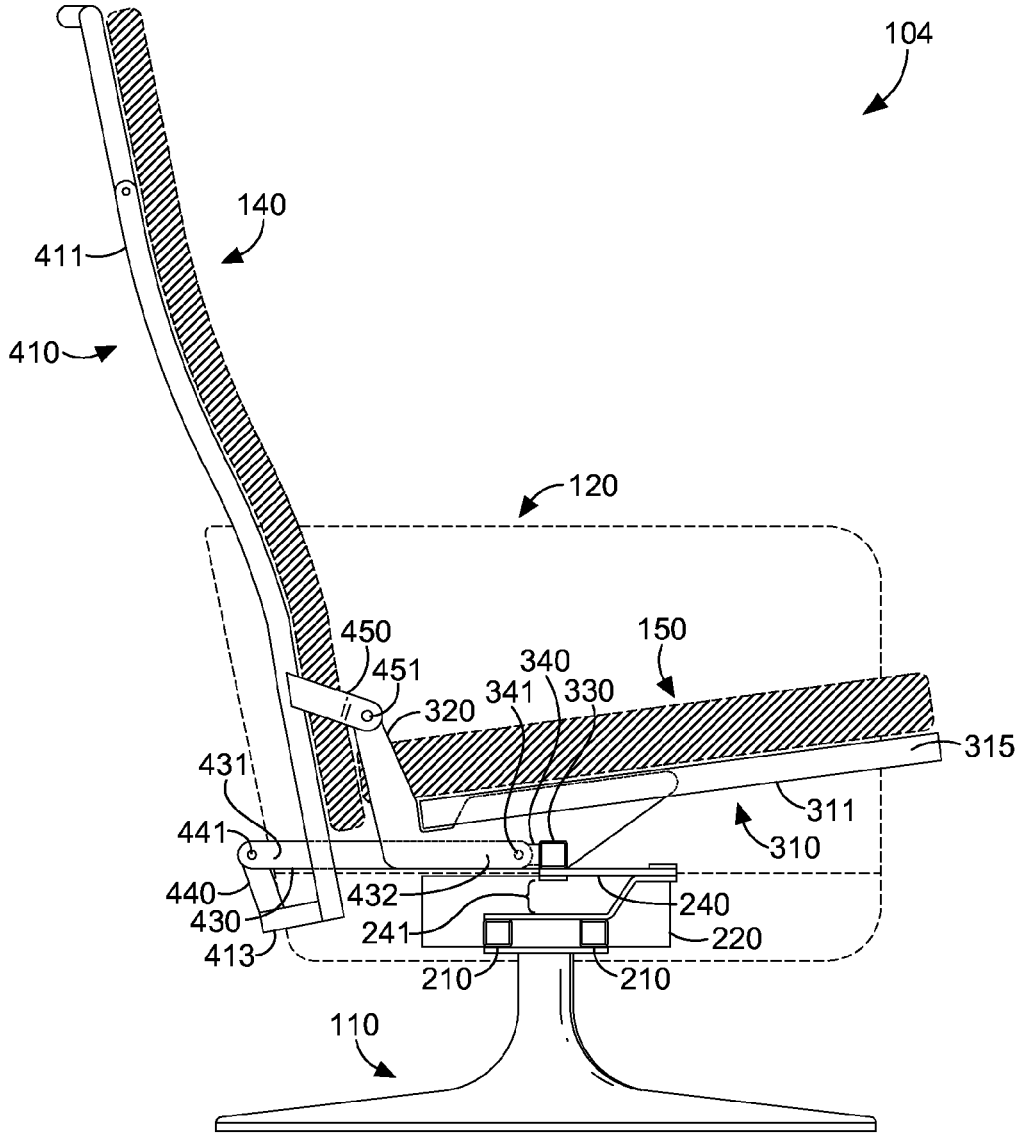
FIG. 8 is a diagrammatic lateral view of a seating unit in an upright position with the armrest(s) and the pedestal base assembled to the support frame, where a backrest frame is fixedly attached to a seat frame, in accordance with an embodiment of the present invention.

Looking briefly at FIG. 8, general components of a seating unit 104 will now be described. Initially, the seating unit 104 has a seat 150 assembled to a seat frame 310, a backrest 140 assembled to a backrest frame 410, and a base (e.g., pedestal base 110 is depicted in FIG. 8). In embodiments, a seating unit 101, as shown in FIG. 5, may include a footrest assembly 500. The footrest assembly 500 is generally configured to extend and retract a first foot-support ottoman 580 and a second foot-support ottoman 590 with respect to the stationary base. Typically, the footrest assembly is configured to extend from between a pair of opposed armrest 120 and retract to a position that is substantially below the seat frame 310.

In addition, the stationary base is connected to a support frame 200 while the seat frame 310 is included within a seat assembly 300. The support frame 200, or chassis, is interconnected to the seat assembly 300 via a rocker mechanism 240, which is generally disposed between the pair of opposed armrests 120. In this way, the seat assembly 300 (including the seat 150) is allowed to sway forward and rearward over the stationary base during adjustment of the seating unit 101.

The opposed armrests 120 are laterally spaced and have an arm-support surface that is typically substantially horizontal. In one embodiment, the pair of opposed armrests 120 are attached to the stationary base (e.g., pedestal base 110 of FIG. 2 or legs 130 of FIG. 3) via intervening members. In another embodiment, the pair of opposed armrests 120 are allowed to sway forward and rearward with respect to the stationary base (e.g., pedestal base 110 of FIG. 1) via the rocker mechanism 240. As used herein, the phrase "rocker mechanism" is not meant to be limiting, but may encompass an apparatus or mechanism that allows one component to sway forward and backward with respect to another component. As illustrated in the figures, the rocker mechanism 240 is depicted as one or more flexible elements (e.g., metal, fiberglass, or plastic spring plate(s)) that extend between and connect to a traverse plate 230 of the support frame 200 and the upper crossbeam(s) 330 of the seat assembly 300. As such, it should be appreciated and understood that embodiments of the present invention contemplate all apparatuses and mechanisms known in the furniture-manufacturing industry that allow for fore and aft movement, and that the scope of "rocker mechanisms" is not limited by the flexible elements illustrated and described herein.

General Movement of the Seating Unit

Concerning the general operation of the seating unit 101, FIGS. 4-7 depict examples of adjustments and/or movements that may be achieved using the inter-couplings between the support frame 200, seat assembly 300, backrest assembly 400, and footrest assembly 500. Generally, the seating unit 101 is able to transition between two positions (upright and reclined) and two conditions (extended and closed).

Figure 4:
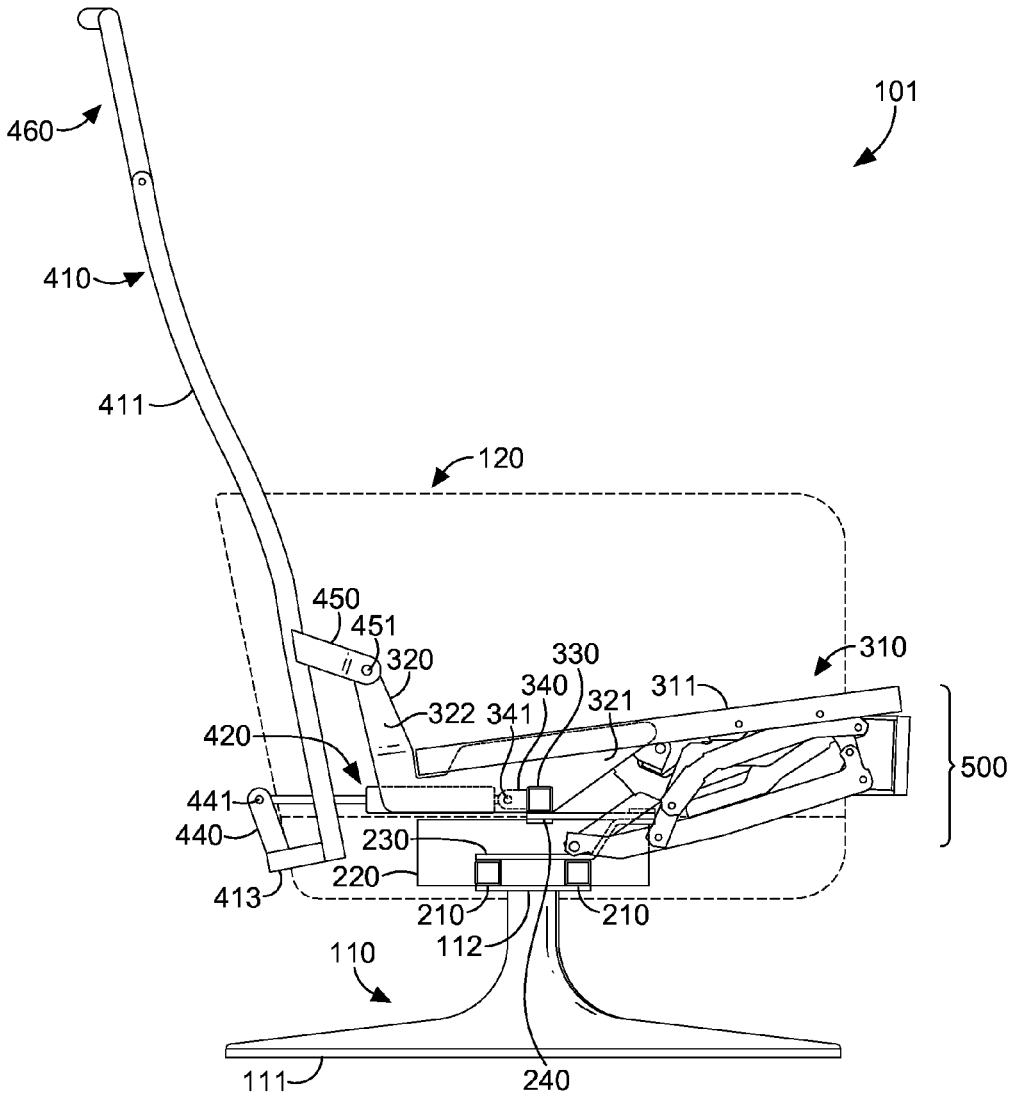
FIG. 4 is a diagrammatic lateral view of a seating unit in an upright position and in a closed condition with the armrest(s) and the pedestal base assembled to the support frame, in accordance with an embodiment of the present invention.

Initially, FIG. 4 shows the seating unit 101 in an upright position of the backrest assembly 400 and in a closed condition of the footrest assembly 500 (e.g., a normal non-reclined sitting position) with the seat 150 in a generally horizontal position and the backrest 140 generally upright and generally perpendicular to the seat 150.

FIG. 5 shows the seating unit 101 in the upright position of the backrest assembly 400 and in an extended condition of the footrest assembly 500. The upright position combined with the extended condition is often referred to as the TV position, where the first ottoman 580 and the second ottoman 590 are extended forward of a forward surface of the pedestal base 110 and disposed generally horizontal when fully extended. As illustrated, the backrest 140 and backrest frame 410 remain substantially perpendicular to the seat 150 and will not encroach an adjacent wall. In this way, the configuration of the seating unit 100 in the TV position provides a space-saving utility. In embodiments of the TV position, the seat 150 may be maintained with a slight inclined orientation relative to a bottom 111 of the pedestal base 110, where the bottom rests upon an underlying surface (e.g., floor, ground, and the like). Typically, the seat 150 is not translated in any direction upon moving the footrest assembly 500 between extend and closed conditions.

Figure 6:
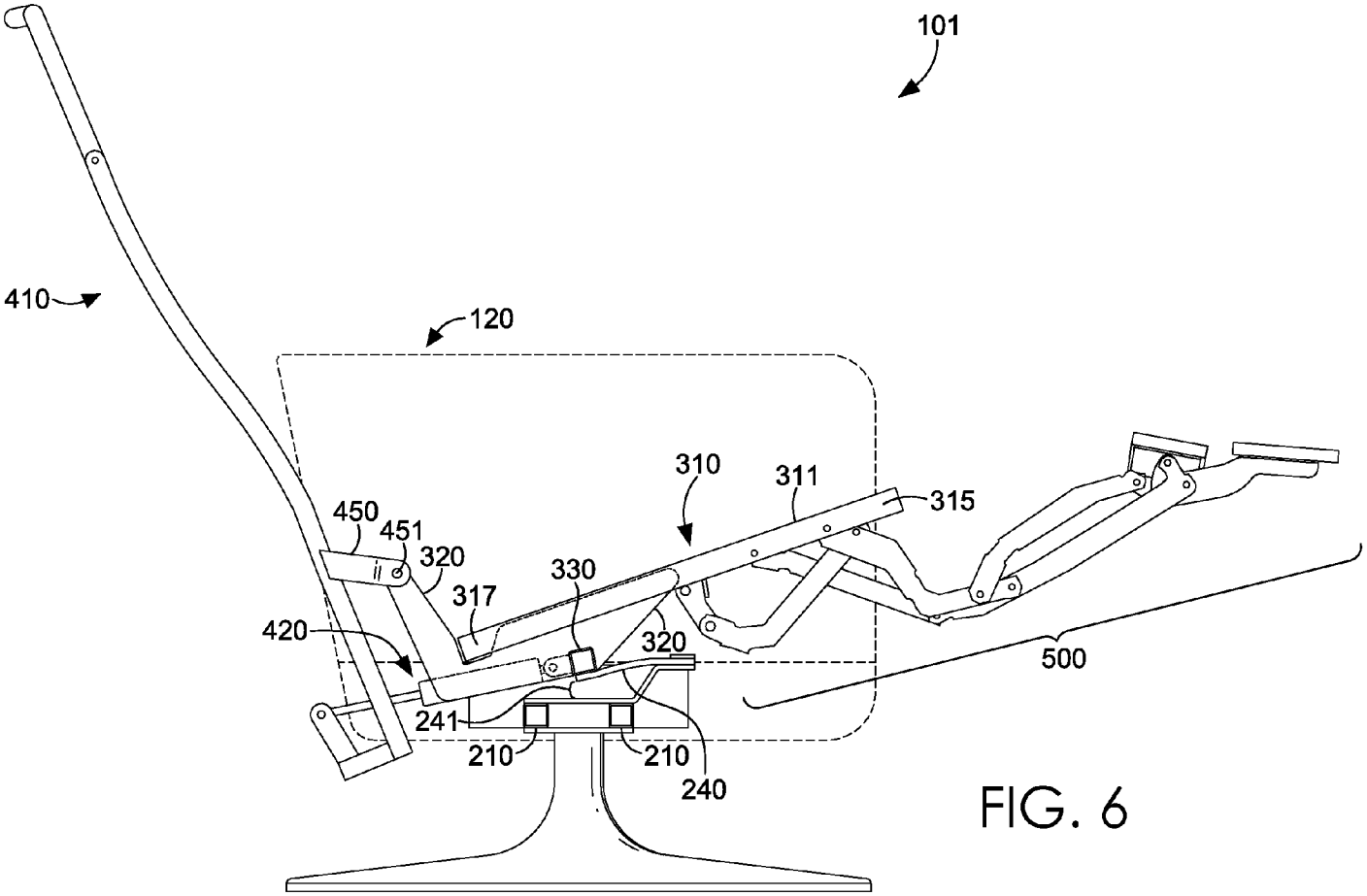
FIG. 6 is a view similar to FIG. 4, but in a rearward bias of the upright position and in the extended condition, in accordance with an embodiment of the present invention.

FIG. 6 shows the seating unit 101 in an adjustment similar to FIG. 5, but with a rearward bias of the upright position. Typically, the rearward bias is accomplished by an occupant of the seating unit 101 shifting their weight rearward in the seat 150 causing the rocker mechanism 240 to bend in a rocking manner. In embodiments, the rocker mechanism 240 is fabricated (e.g., via selection of material(s) and dimensions of the material(s)) to allow for an angular range of sway of the backrest 140 with respect to the seat 150. For example, in some recliners, the angular range between a forward bias of the upright position (see FIG. 5) and the rearward bias of the upright position (see FIG. 6) may begin at approximately 90 degrees and end at approximately 125 degrees. But other sizes of angular ranges with differing beginning and ending degrees are contemplated by embodiments of the present invention, as the example above is provided for purposes of explanation only. Further the size of the angular range and/or beginning and ending degrees may be fixed or adjustable by an occupant of the seating unit 101.

Figure 7:
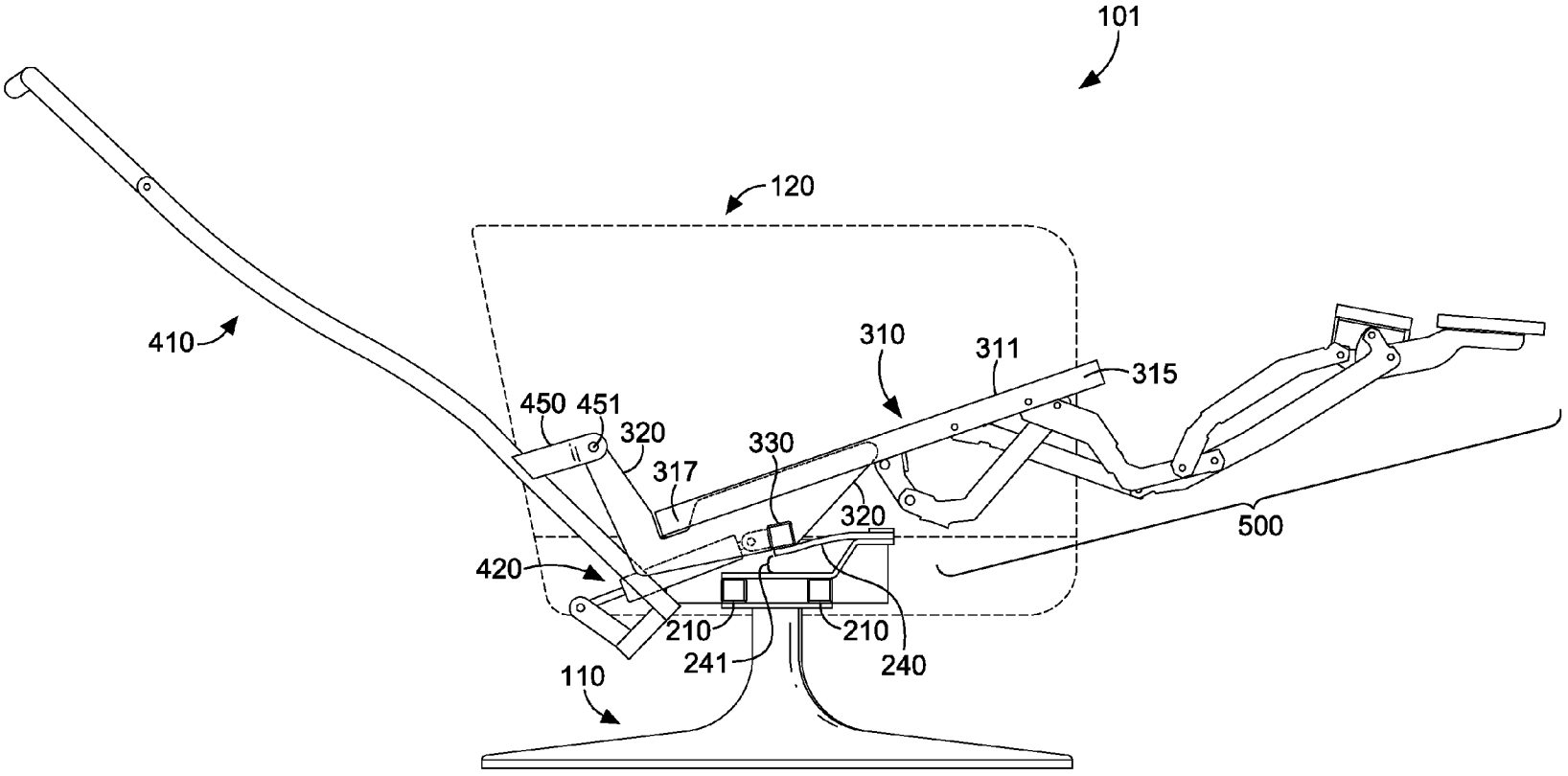
FIG. 7 is a view similar to FIG. 4, but in a reclined position and in the extended condition, in accordance with an embodiment of the present invention.

Finally, FIG. 7 shows the seating unit 101 in a reclined position and in the extended condition. In this position, the backrest 140 and backrest frame 410 are rotated rearward about pivot 451, where rotation is stabilized through use of a gas spring 420, or other motion-controlling device. When the relined position is achieved, the rearward inclination angle of the backrest 140 typically resides in an obtuse angle in relation to the seat 150. It should be noted that the footrest assembly 500 acts independently from the backrest assembly 400 such that adjustment of the backrest 140 and adjustment of the ottomans 580 and 590 are mutually exclusive. Thus, although illustrated in the extended condition, the footrest assembly 500 may assume the closed condition when the backrest assembly 400 resides in the reclined position. Also, it should be noted that the rocker mechanism 240 allows the bias rearward and forward (i.e., swaying fore and aft in a rocking motion) while the backrest assembly resides within the reclined position. As such, when the backrest 140 is biased rearward, the ottomans 580 and 590 may be moved farther upward from their position in the initial extended condition.

As illustrated in FIGS. 4-7, the armrests 120 are attached to lower crossbeam(s) 210 of the support frame 200. Accordingly, the seat 150 and the backrest 140 are allowed to move independent from the armrests 120. This independent movement of the seat 150 from the armrests 120 in FIGS. 6 and 7 allows for a variety of styling to be incorporated into the seat 150, such as T-cushion styling, and the backrest 140, such as a wing-back styling.

Variations of the Seating-Unit Configuration

Upon a brief discussion of the various positions and conditions the seat assembly 300, the backrest assembly 400, and the footrest assembly 500 may assume, a discussion of the various configurations of the seating units 100, 101, 102, 103, 104, and 105 will now follow. Initially, it should be noted that the seating units 100, 101, 102, 103, 104, and 105 include similar components. But the way the components are assembled govern the differing features and functionality of the seating units 100, 101, 102, 103, 104, and 105. Stated another way, embodiments of the present invention of a single seating unit may be assembled according to different specifications, which allow for a broad scope of design choices and operation characteristics using a discrete set of components.

Figure 1:
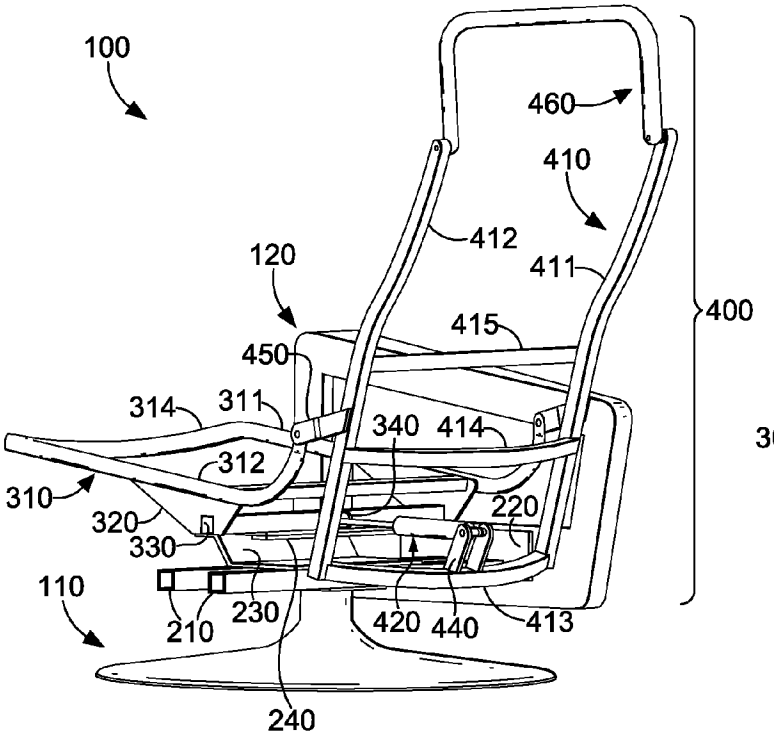
FIG. 1 is a perspective view of a seating unit in an upright position with one or more armrests assembled to a support frame and a pedestal base assembled to the support frame, in accordance with an embodiment of the present invention.

Initially, the seating unit 100 of FIG. 1 is arranged with the armrests 120 attached to the base 200. Accordingly, the armrests 120 are fixed to the pedestal base 110 via intervening links. Meanwhile, the armrests 120 are isolated from the seat frame 310 (for holding the seat 150) and the backrest frame 410 (for holding the backrest 140). This separation of movement between the armrests 120 and the seat 150 and the backrest 140 makes it possible to provide the seating unit 101 with T-cushion styling along with pivot-over-the-arms wing styling. Further, the seating unit 101 may be provided with a standalone ottoman (not shown).

The seating unit 101 of FIGS. 4-7 is substantially similar in configuration to the seating unit 100 described above, but with a footrest assembly 500 integrated within the seating unit 101. Generally, as mentioned previously, the footrest assembly 500 is adapted to move between an extended and closed condition independently of the adjustment of the seat assembly 300 and the backrest assembly 400 between the upright and reclined positions.

The seating unit 102 of FIG. 2 is arranged with the armrests 120 attached to the seat frame 310. Accordingly, the armrests 120 are fixed to the seat assembly 300 via intervening links. Meanwhile, the armrests 120 are isolated from the base 200, including the pedestal base 110. This separation of movement between the armrests 120 base 200 makes it possible to provide a seating unit 102 that allows for rocking the armrests 120 together with the seat 150. Further, the seating unit 102 may be provided with a standalone ottoman (not shown).

Figure 3:
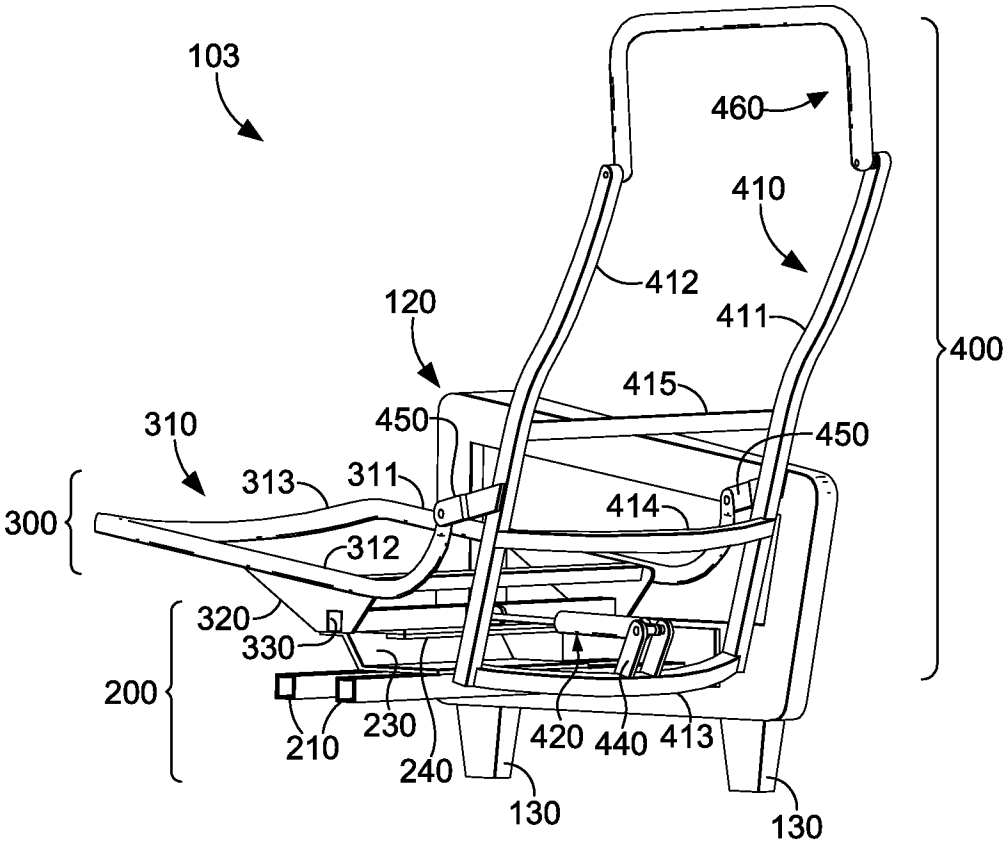
FIG. 3 is a perspective view of a seating unit in the upright position with one or more armrests assembled to the support frame and legs assembled to armrest(s), in accordance with an embodiment of the present invention.

The seating unit 103 of FIG. 3 is arranged with the armrests 120 attached to the support frame 200, similar to seating units 100 and 101. But, in this configuration, the armrests 120 are fixed to legs 130 for holding the support frame 200 above an underlying surface, as opposed to using the pedestal base 110 for vertical support. Thus, the armrests 120 of the seating unit 103 indirectly rest on a floor (via the legs 103) while allowing for full reclining and rocking motion. Further, the design of the seating unit 103 allows for extending a chair to construct a fully functioning unit of two or more seats (i.e., loveseat or sofa) with one or more, independently adjustable seat assemblies 300, backrest assemblies 400 and footrest assemblies 500.

It should be noted that seating unit 103, along with seating units 100, 101, and 102 are each equipped with at least one mechanism, such as a gas spring 420 (air piston), a mechanical device, or a linear actuator, that allows the backrest frame 410 to recline with respect to the seat frame 310 and/or the support frame 200. Generally, the gas spring 420 includes a piston (rod end) and a gas cylinder (head end). The piston is moveable within the gas cylinder between an extended position (see FIG. 6) and a retracted position (see FIG. 7). The gas cylinder typically contains a gas (not shown). When the piston is moved from the expanded position towards the retracted position, the gas in the gas cylinder is compressed and consequently applies a force against the piston resisting the compression. As such, the piston of the gas spring 420 is substantially biased toward the expanded (upright) position.

Figure 9:
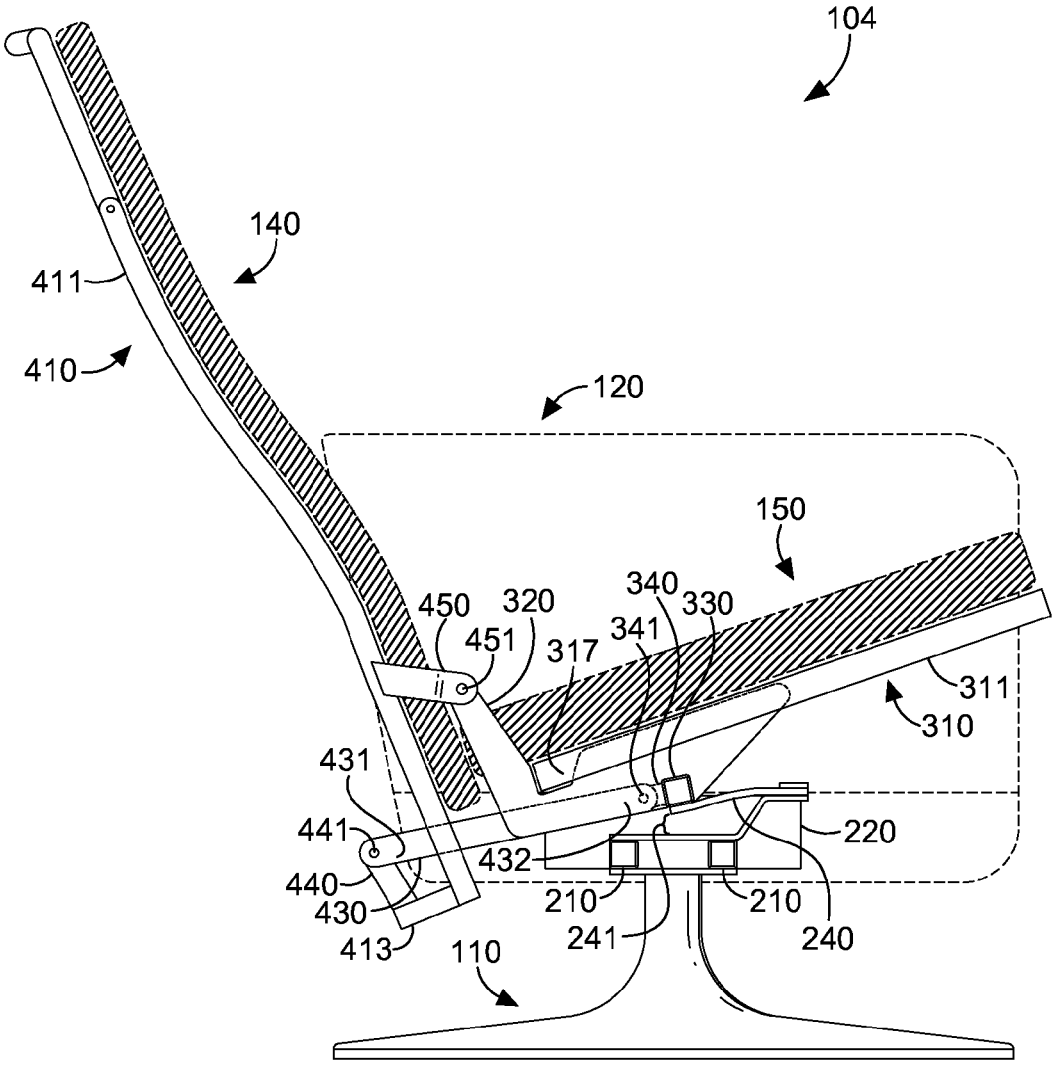
FIG. 9 is a view similar to FIG. 8, but in a rearward bias of the upright position, in accordance with an embodiment of the present invention.

The seating unit 104 of FIGS. 8 and 9 is arranged with the armrests 120 attached to the base 200, such that the armrests 120 are fixed to the pedestal base 110 via intervening links, similar to seating units 100 and 101. Dissimilar to seating units 100 and 101, the seating unit 104 includes a solid link, or connector link 430, in place of the gas spring 420. Typically, the seating units 100-105 are designed such that the connector link 430 is interchangeable with the gas spring 420. For example, with reference to FIG. 8, pivots 441 and 341 where the gas spring 430 is pivotably coupled to the lower horizontal member 413 and the upper crossbeam 330, respectively, may be reused when the gas spring 420 is replaced with the connector link 430. In embodiments, a rearward portion 431 of the connector link 430 is coupled to the mounting bracket 440 on the lower horizontal member 413 at the pivot 441 while a forward portion 432 of the connector link 430 is coupled to the mounting bracket 340 on the upper crossbeam 330.

In operation, the connector link 430 prevents the backrest frame 410 from moving independently from the seat frame 310 (i.e., fixing the assemblies 300 and 400 together). Accordingly, back recline adjustment is prevented, providing the back 140 and the seat 150 with various styling options. The seating unit 104 also provides an occupant the ability to rock fore and aft with the assemblies 300 and 400 swaying as a single unit. Further the seating unit 104 retains the ability to be outfitted with the integrated footrest assembly 500, if desired by a customer.

Figure 13:
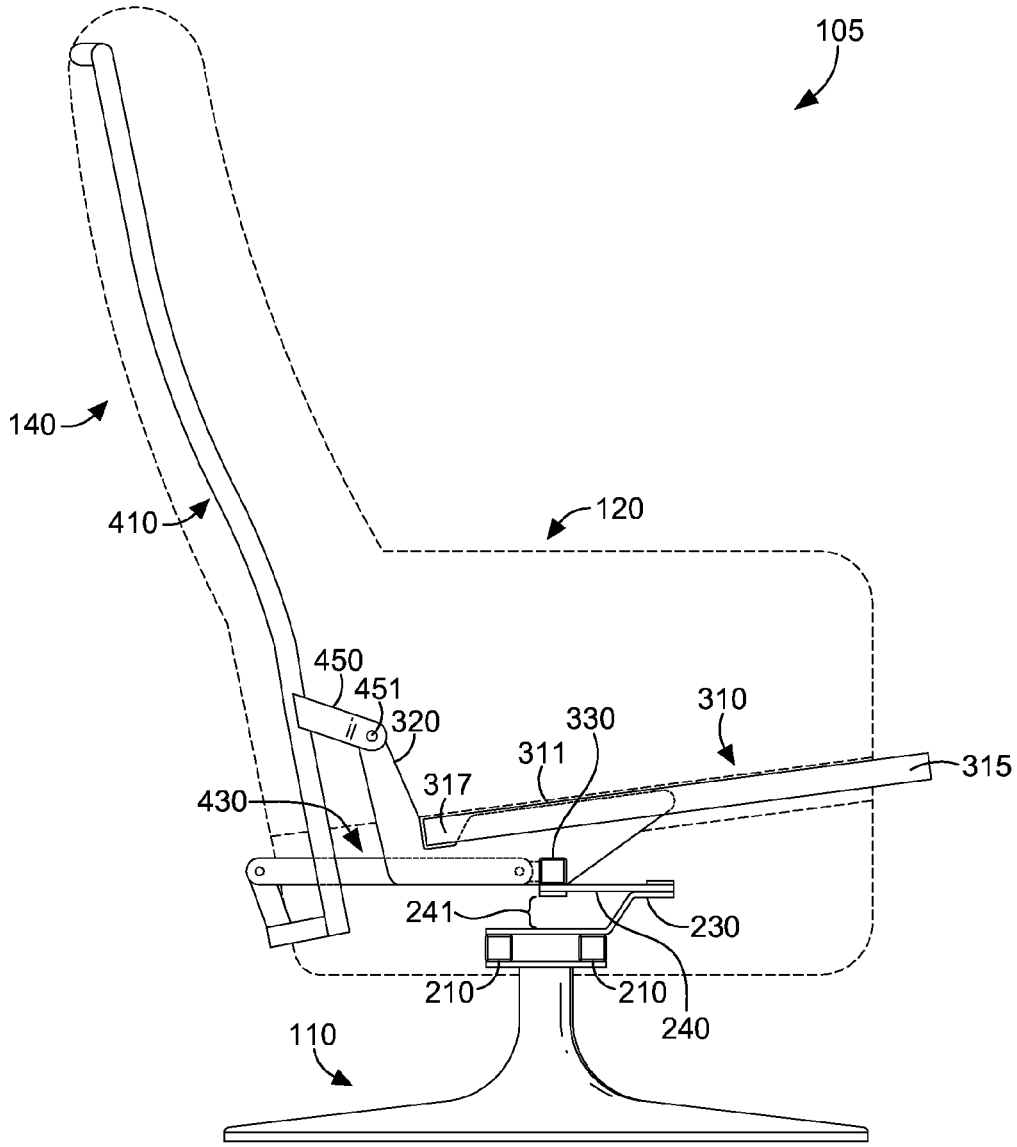
FIG. 13 is a diagrammatic lateral view of a seating unit in an upright position with the armrest(s) assembled to the seat assembly and the pedestal base assembled to the support frame, where a backrest frame is fixedly attached to a seat frame, in accordance with an embodiment of the present invention.
Figure 14:
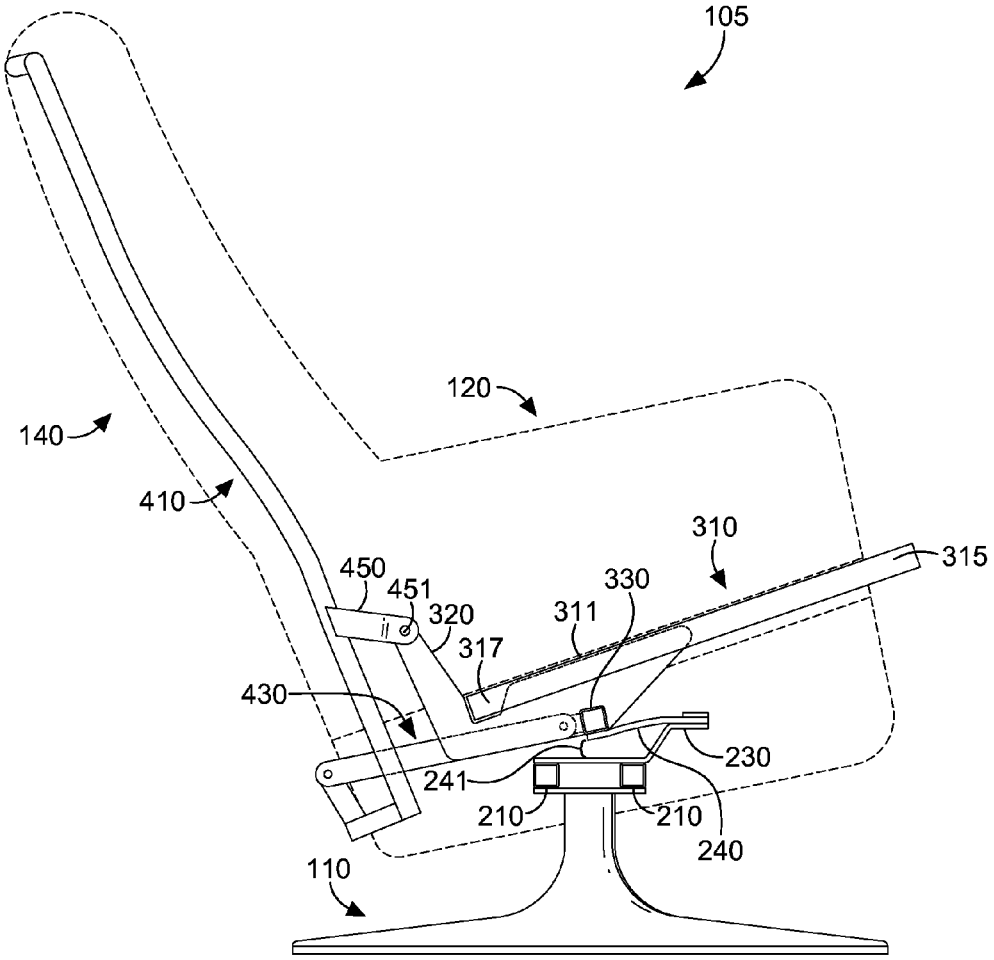
FIG. 14, is a view similar to FIG. 13, but in a rearward bias of the upright position, in accordance with an embodiment of the present invention.

The seating unit 105 of FIGS. 13 and 14 is similar to the seating unit 104 (i.e., including a connector link 430 in place of the gas spring 420), but arranged with the armrests 120 attached to the seat frame 310 as opposed to the base 200. Thus, the armrests 120 rock with seat 150 when an occupant of the seating unit 105 is using the rocker mechanism 240 to sway fore and aft. As can be seen in FIGS. 13 and 14, various styling designs may be applied to the seating unit 105 (e.g., integrated cushions) because the armrests 120, seat 140, and back 150 are all fixed to one another.

Assemblies of the Seating Unit

Turning to FIGS. 1 and 2, various assemblies comprising the seating units 100-105 will now be described. Initially, the seating units 100-105 include the support frame 200, the seat assembly 300, and the backrest assembly. In embodiments, the seating units 100-105 may include the footrest assembly, which will be described below with reference to FIGS. 4-7. As shown in FIGS. 1 and 2, the support frame 200 includes one or more lower crossbeams 210, a side plate 220 (when the armrests 120 are attached to the support frame 200), a traverse plate 230, and a rocker mechanism 240. In one instance, the one or more lower crossbeams 210 may be coupled to a base (e.g., pedestal base 110), where the coupling is typically made with an apparatus that allows the support frame 200 to swivel left and right with respect to the base. In another instance, the one or more lower crossbeams 210 may be coupled to the armrests 120 via the side plate 220 without connecting to the base, as shown in FIG. 3.

The traverse plate 230 is typically at least one formed piece of sheet metal that is fixedly attached to one or more of the lower crossbeams 210 and extends upward therefrom. In embodiments, a lower surface of the traverse plate 230 is attached to one or more of the lower crossbeams 210, while an upper surface of the traverse plate 230 is attached to a forward end of the rocker mechanism 240. In effect, the traverse plate 230 creates a spacing 241 (see FIG. 5), or vertical gap, between the one or more lower crossbeams 210 and the rocker mechanism 240. This spacing allows the rocker mechanism 240 to sway without its rearward end contacting the one or more lower crossbeams 210 or the traverse plate 230.

The rocker mechanism 240 acts to allow the seat assembly 300 to sway, or rock, with respect to the support frame 200, or chassis. As mentioned above, the rocker mechanism 240 may comprise any component or device that facilitates rocking between two objects. As shown, in embodiments, the rocker mechanism 240 is provided as an arrangement of flexible elements (e.g., evenly spaced fiberglass strips or spring plates). For example, the flexible elements may be 5.5 inches long, 2.5 inches wide, and 5/16 inches thick. However, the dimensions and material composition of the flexible elements may vary according to a stiffness in sway preferred by a customer. Other examples of the flexible elements include metal rods, spring plates, helical springs (horizontal and/or vertical), and reinforced plastic or rubber elements.

Although particular configurations of the rocker elements 240 have been described, it should be understood and appreciated that other types of suitable devices that allow the seat assembly 300 and the backrest assembly 400 to bias rearward with respect to the chassis when an occupant leans back in the seating unit may be used, and that embodiments of the present invention are not limited to a flexible elements as described herein. For instance, the rocker mechanism 240 may be an electric actuator controlled by a pressure sensor that reclines or inclines dynamically as the occupant's weight shifts within the seat 150.

The seat assembly 300 includes the seat frame 310, a seat-mounting plate 320, one or more upper crossbeams 330, and a mounting bracket 340 that is fixed to the upper crossbeams 330. The seat assembly 300 may, in embodiments, include intervening members and hardware coupled to any of the members above when the armrests 120 are attached to the seat assembly 300. In one instance, the seat frame 310 includes various members assembled to carry the seat 150. These various members includes a right lateral member 311, a left lateral member 312, a forward member 313, and a rearward member 314. As illustrated in FIG. 2, these members 311-314 may be coupled end-to-end to form a perimeter of the seat frame 310. Or, the members 311-314 may represent lengths of a continuous piece that is formed into the seat frame 310. It should be noted that the seat frame 310 may contain more or less members than the members 311-314. For instance, as illustrated in FIG. 1, the seat frame 310 includes just members 311-313.

The seat-mounting plates 320 are fixedly attached to the seat frame 310. In one instance, a top of a forward portion 321 of the seat-mounting plates 320 is coupled to the right and left lateral members 311 and 312, respectively, while a section of a rearward section 322 of the seat-mounting plates 320 is coupled pivot links 450, respectively, of the backrest assembly 400. In embodiments, at least one of the upper crossbeams 330 span and is fixedly attached to a section of the forward portion 321 of the seat-mounting plates 320. Thus, in these embodiments, the seat frame 310 and the upper crossbeams 330 act as a single unit.

In embodiments, the crossbeams 210 and 330 function as a set of crossbeams and may be formed from square metal tubing, as well as the members 311-314 of the seat frame 310. Alternatively, other components, such as the seat-mounting plate 320, are typically formed from metal stock, such as stamped, formed steel. However, it should be understood and appreciated that any suitable rigid or sturdy material known in the furniture-manufacturing industry may be used in place of the materials described above. For instance, as mentioned above, the rocker mechanism 240 may include molded plastic, fiberglass, or another resilient material.

With reference to FIG. 3, the backrest assembly 400 will now be described. The backrest assembly 400 includes the backrest frame 410, the gas spring 420 (or other backrest-biasing mechanism or connector link 430), a mounting bracket 440, and pivot link(s) 450. Generally, the backrest frame 410 includes various members, similar to the seat frame 310, assembled to carry the backrest 140. These various members includes a right vertical member 411, a left vertical member 412, a lower horizontal member 413, a mid-horizontal member 414, and an upper horizontal member 415. As illustrated in FIG. 3, these members 411-415 may be coupled to form a structure of the backrest frame 410, where the members 413-415 span and couple the members 411 and 412. Or, the members 411-413 may represent lengths of a continuous piece that is formed into the backrest frame 410. It should be noted that the backrest frame 410 may contain more or less members than the members 411-415.

In some embodiments, the backrest frame 410 includes an adjustable headrest link 460. This link 460 may be pivotably coupled to an upper portion of the members 411 and 412, respectively. In operation, the link 460 is coupled to a headrest such that the headrest is adjustable forward and rearward with respect to the backrest 140, which is coupled to a remainder of the backrest frame 410.

The lower horizontal member 413 is coupled to the gas spring 420 (see FIG. 3) or the connector link 430 (see FIG. 8) via the mounting bracket 440. In embodiments that allow for biasing the backrest frame 410 with respect to the seat frame 310, the gas spring 420 is pivotably coupled at a first end (e.g., piston or rod end) to the mounting bracket 440, which is fixedly attached to a mid-portion of the lower horizontal member 413. In these embodiments, a second end (e.g., head end) of the gas spring 420 is pivotably coupled to the mounting bracket 340, which is attached to a mid-portion of at least one of the upper crossbeam(s) 330. In embodiments that restrict and/or prevent biasing the backrest frame 410 with respect to the seat frame 310, the connector link 430 is pivotably coupled at a first end to the mounting bracket 440 and a second end of the connector link 430 is pivotably coupled to the mounting bracket 340. It should be noted that the location of attachment of the mounting brackets 340 and 440 may vary based upon, in part, the style of seating unit 100-105.

Typically, the pivot links 450 are employed to pivotably couple the backrest frame 410 to the seat assembly 300. In one instance, when armrests 120 are attached to the support frame 200 (see FIG. 1), the pivot links 450 are fixedly attached at a first end to the left and right vertical members 411 and 412, respectively, and are pivotably coupled at a second end to the right and left lateral members 311 and 312, respectively, of the seat frame 310. In another instance, when armrests 120 are attached to the seat assembly 300 (see FIG. 2), the pivot links 450 are fixedly attached at a first end to the left and right vertical members 411 and 412, respectively, and are pivotably coupled at a second end to the seat-mounting plates 320.

As mentioned above, the footrest assembly 500 may be provided as an option to the seating unit 101 (see FIGS. 4-7).

Although one embodiment of the footrest assembly 500 is illustrated and described, it should be noted that the footrest assembly 500 is exemplary for the purpose of explanation and any type of static or collapsible footrest may be installed to the seating unit 101. That is, embodiments of the present invention are not limited to the configuration and operation of the footrest assembly 500.

The footrest assembly 500 includes a number of links 510, 520, 530, 540, 550, 560, and 570 that articulate to extend and retract one or more ottoman(s) 580 and 590. With reference to FIG. 5, the first actuator link 510 includes a first end coupled to a mid-portion 316 of the seat frame 310 at pivot 511 and a second end coupled to the second actuator link 520 at pivot 513. It should be noted that the coupling between the first actuator link 510 and the seat frame 310 may be made directly with the pivot 511 or indirectly using intervening links and/or brackets and pivot(s). A back end of the second actuator link 520 is coupled to the first actuator link 510 at the pivot 513 and a front end of the second actuator link 520 is coupled to the forward swing link 540 at pivot 544.

Typically, a handle, cable attachment, or other actuation control is incorporated within the footrest assembly 500 to manually move the footrest assembly 500 over-center into the extended condition. In an exemplary embodiment, the actuation control is coupled to either the first actuator link 510 or the second actuator link 520. By manually adjusting the actuation control—with the assistance of a spring to counterbalance the occupant's weight, in embodiments—the links 510 and 520 rotate forward about the pivot 511. This counterclockwise rotation, with reference to FIG. 5, converts to a lateral/directional force at the pivot 544 of the forward swing link 540. The forward swing link 540, in turn, rotates counterclockwise about pivot 541 driving the links 530, 550, 560, and 570 forward and upward, thereby exposing the ottoman(s) 580 and 590. Upon completion of the counterclockwise rotation of the forward swing link 540 about the pivot 541, the footrest assembly 500 is pushed out to the extended condition. Reversing the steps above (i.e., manually adjusting the actuation control out of over-center) causes the footrest assembly to collapse to the closed condition.

As mentioned above, the forward swing link 540 is coupled at a back end to a forward portion 311 of the seat frame 310 at the pivot 541. A mid-section of the forward swing link 540 is coupled to the second actuator link 520 at the pivot 544. A front end of the forward swing link 540 is coupled to the upper swing link 550 at pivot 542, and the front end of the forward swing link 540 is coupled to the lower swing link 560 at pivot 543. The rearward swing link 530, which rotates in a substantially similar parallel path to the forward swing link 540, is also coupled to the forward portion 311 of the seat frame 310 at a location rearward of the pivot 541. In one embodiment, a back end of the rearward swing link 530 is coupled to the seat frame 310 at pivot 531 and a front end of the rearward swing link 530 is coupled to the lower swing link 560 at pivot 532.

Rotation of the swing links 530 and 540 translate the swing links 550 and 560 forward and away from the seat frame 310, which causes the ottoman(s) 580 and 590 to reach a substantially horizontal disposition when the footrest assembly 500 is fully extended. The upper swing link 550 includes a back end coupled to the forward swing link 540 at the pivot 542 and a front end coupled to the first ottoman 580 at pivot 582. The lower swing link 560 includes a back end coupled to the forward swing link 540 and the rearward swing link 530 at the pivots 543 and 542, respectively. And the lower swing link 560 includes a front end coupled to the first ottoman 580 the ottoman extender link 570 at pivots 582 and 571, respectively. The ottoman extender link 570 is coupled to the lower ottoman bracket 560 at the pivot 571 and to the second ottoman 590. It should be noted that the term "ottoman" is used broadly herein to describe a support (e.g., link or other rigid object) for a footrest (e.g., cushion or other non-rigid object), the footrest itself, or a combination thereof.

The Gas Spring

Although described herein as a particular embodiment, the compressible gas spring 420 may represent or be replaced by any type of biasing member allows the backrest assembly 400 to recline with respect to the seat assembly 300. In one embodiment, the biasing member may be a device that applies a constant force in one direction and/or provides a predefined resistance to an average person who leans against the backrest 140 when moving the seating unit 100-103 from the upright position to the reclined position, but provides a sufficient force to automatically return the seating unit 100-103 to the upright position when the user's weight is removed from the backrest 140. As such, the predefined resistance established within the biasing member is based upon, in part, the weight of the backrest 140, the user's preferred force adjusting to the reclined position, and, when unoccupied, the force for adjusting automatically to the default upright position. Although the biasing member has been described as the gas spring 420, as mentioned above, the biasing member 420 may be any suitable biasing member, such as a gas dampner, a linear actuator, a power drive, a motor drive, or an electric screw drive, among other appropriate biasing members.

Operation of the Seating Unit

Figure 10:
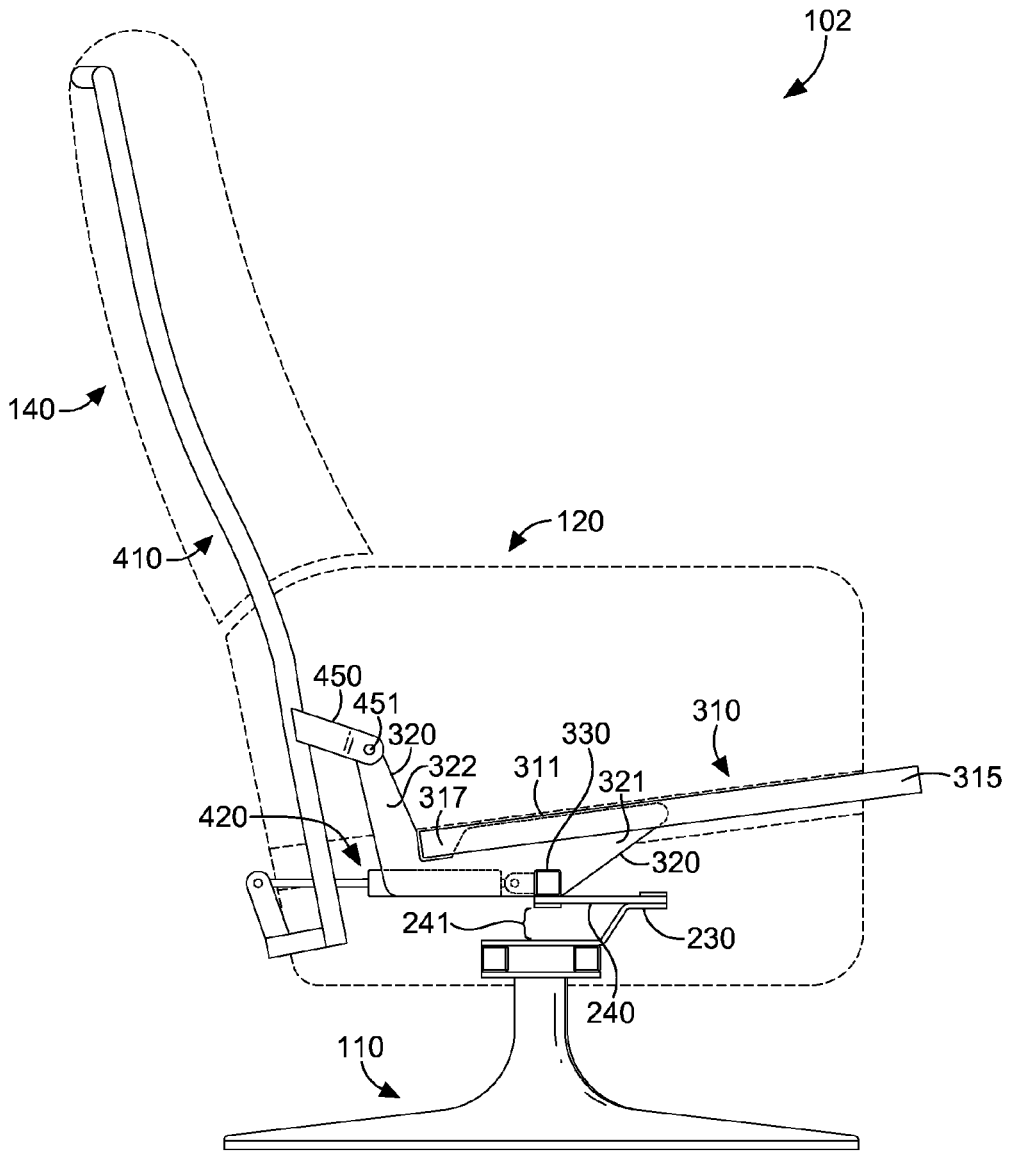
FIG. 10 is a diagrammatic lateral view of a seating unit in an upright position with the armrest(s) assembled to the seat assembly and the pedestal base assembled to the support frame, in accordance with an embodiment of the present invention.
Figure 11:
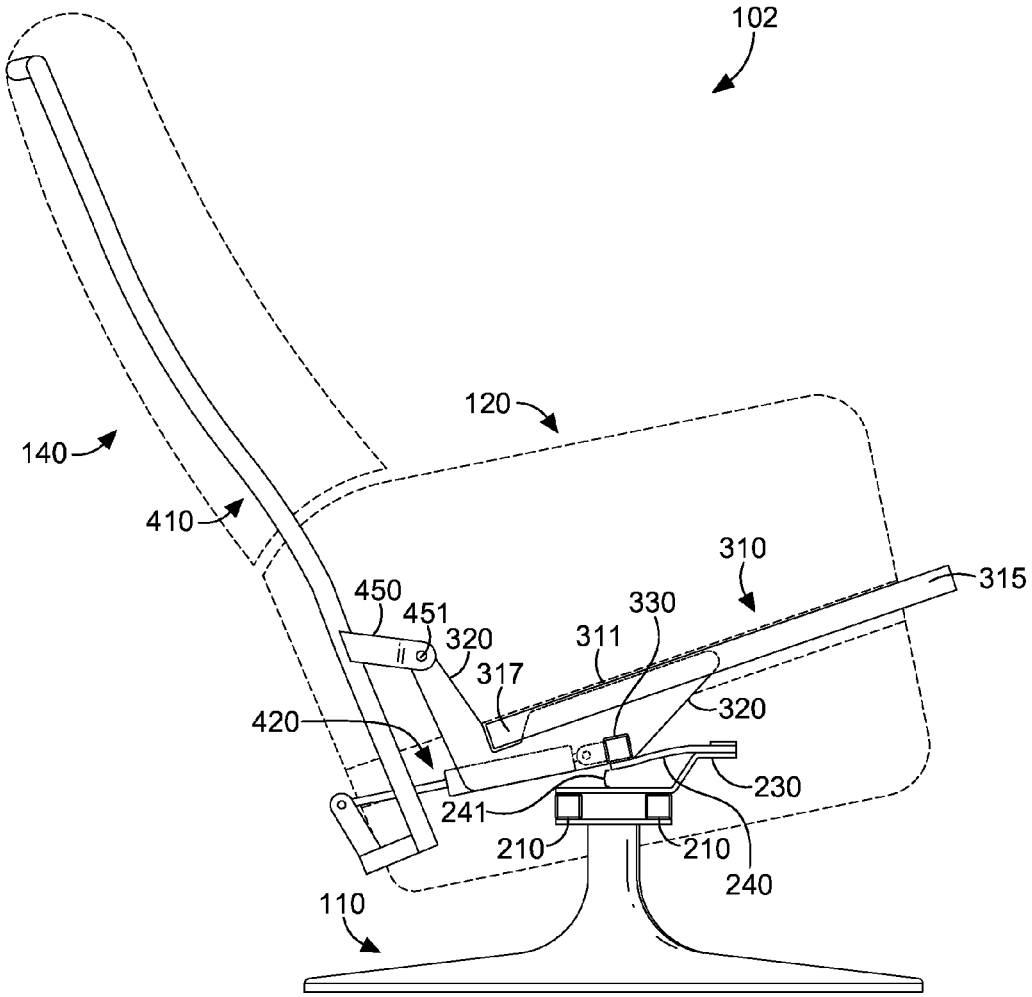
FIG. 11 is a view similar to FIG. 10, but in a rearward bias of the upright position, in accordance with an embodiment of the present invention.
Figure 12:
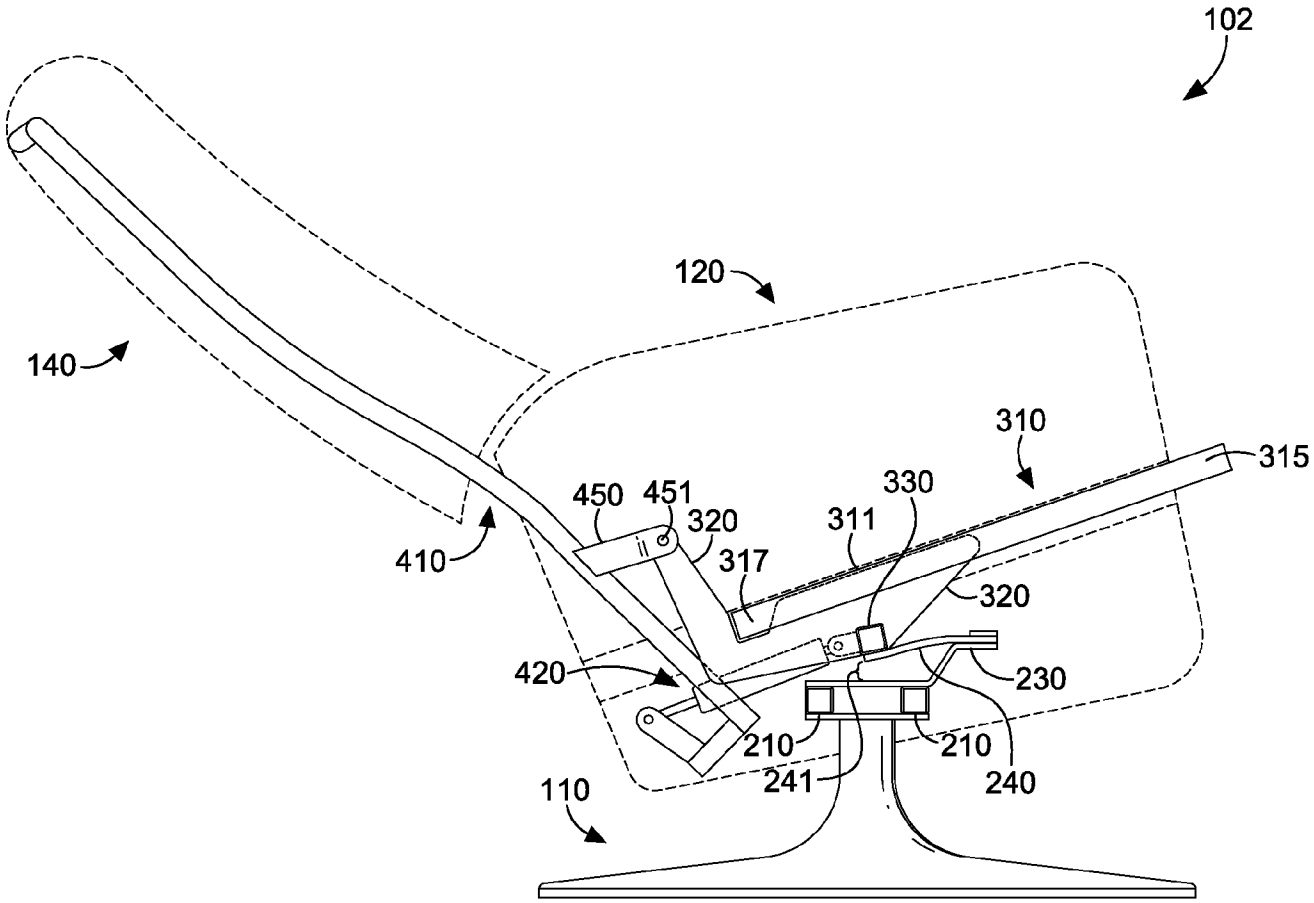
FIG. 12 is a view similar to FIG. 11, but in a reclined position, in accordance with an embodiment of the present invention.

As discussed above, the seating unit 101 of FIGS. 4-7 is designed to articulably actuate to induce movement of the seat 150, the backrest 140, and the ottoman(s) 580 and 590 upon an occupant of the seating unit making adjustments between the positions shown in FIGS. 4-7. As a result, in embodiments, the seating unit 101 is adjustable to a variety of positions: upright position (see FIGS. 8, 10, and 13); upright position in a closed condition (see FIG. 4); upright position in an open condition (see FIG. 5); upright position with a rearward bias due to rocking backward (see FIGS. 9, 11, and 14); upright position with a rearward bias in the open condition (see FIG. 6); reclined position with a rearward bias (see FIG. 12); and reclined position with a rearward bias in the open condition (see FIG. 7). It should be noted that, in exemplary embodiments, the seating unit 101 is able to move between the following adjustments independent of one another: upright position and reclined position; rearward bias and forward bias due to rocking backward and forward, respectively; and extended condition and closed condition. Thus, the occupant of the seating unit 101 is able to achieve a multitude of configurations of the seating unit by mixing and matching these adjustments.

Generally, the linkages within the seating unit 101 are arranged to actuate and control movement of the seating unit 101 during movement. For instance, these linkages facilitate movement between the positions, such as from the reclined position (i.e., backrest 140 is rotated rearward and orientated in a inclination angle that is obtuse in relation to the seat 150) to the upright position (i.e., seat 150 is rotated to a generally horizontal position and the backrest 140 generally upright and in a substantial, perpendicular-biased relation to the seat 150). In another embodiment, the linkages facilitate movement between other adjustments, such as the adjustment to the extended condition in which the ottoman(s) 580 and 590 are extended forward and disposed generally horizontal.

These linkages may be pivotably interconnected. It is understood and appreciated that the couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

A discussion of movements of the seating unit 101, with the aid of the linkages discussed above, will now commence with reference to FIGS. 4-7. In FIG. 4, the seating unit 101 resides in the upright position with footrest assembly 500 in the closed condition. In FIG. 5, the seating unit 101 is adjusted to the extended condition. The transition from the closed to extended condition is triggered upon an occupant of the seating unit 101, or another user, invoking an actuation mechanism (e.g., cable or handle) to propel the actuator links 510 and 520 into an over-center state. Upon achieving the over-center state, the footrest assembly 500 thrust the ottoman(s) 580 and 590 forward and upward, as more fully described above.

In FIG. 6, the seating unit 101 remains in the upright position within the extended condition. But, the seating unit is adjusted from a forward bias (see FIG. 5) to a rearward bias (see FIG. 6). This adjustment is invoked by the occupant of the seating unit 101 leaning slightly rearward on the backrest 140 or shifting their weight back on the seat 150. This action by occupant causes the rocker mechanism 240 to flex downward, which changes the angular orientation of the backrest frame 410 and the seat frame 310 with respect to the support frame. Typically, the rocker mechanism 240 is flexible within a continuous range, such that many angular orientations may be achieved based upon a position of or weight distribution created by the occupant. Reference numeral 241 illustrates the downward flex of the rocker mechanism 240, in embodiments, and how the upper crossbeam(s) 330 encroach upon the lower crossbeam(s) 210 when swaying rearward.

In FIG. 7, the seating unit 101 adjusts from the upright position to the reclined position while remaining in the extended condition and the rearward bias. This adjustment is invoked by the occupant of the seating unit 101 leaning heavily rearward on the backrest 140. When a force of the rearward lean overcomes the threshold amount of pressure to compress the gas spring 420, the backrest frame 410 changes angular orientation with respect to the seat frame 310. In an exemplary embodiment, this action by occupant causes the backrest 140, the backrest frame 410, and the pivot link 450 to rotate counterclockwise about the pivot 451, while the seat frame 310 and seat-mounting plate 320 remain in place. Thus, the backrest 140 is controllably biased forward and rearward with respect to the seat 150 using the gas spring 420.

It should be understood that the construction of the seating units 100-105 lends itself to enable the various members, brackets, devices, and drive bar(s) to be easily assembled and disassembled from the remaining components in order to construct and deconstruct, respectively, the various configurations described above. Specifically, the nature of the pivots and/or mounting locations allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A rocker-type seating unit having a base, a seat support, and a backrest support, the seating unit being adapted to move between an upright position and a reclined position, the seating unit comprising:

a support frame that comprises:

(a) one or more lower crossbeams that are coupled to the base, which holds the support frame above an underlying surface; and (b) a traverse plate that is fixedly attached to and extends upward from the one or more lower crossbeams;

a seat assembly that comprises:

(a) a seat frame for carrying the seat support over the support frame;

(b) seat-mounting plates that are fixedly attached to and extend downward from the seat frame; and (c) an upper crossbeam that spans and couples the seat-mounting plates; and a rocker mechanism that is connected to the upper crossbeam on a first end and connected to the traverse plate on the second end, wherein the interconnection of rocker mechanism enables a controlled, fore-and-aft sway of the seat assembly with respect to the support frame.

2. The seating unit of claim 1, further comprising a footrest assembly that extends and retracts the at least one foot-support ottoman, wherein the footrest assembly is pivotably coupled to a forward portion of the seat frame.

3. The seating unit of claim 2, wherein the footrest assembly is configured to extend the at least one ottoman to an extended condition, and wherein the footrest assembly is configured to retract the at least one ottoman to a closed condition.

4. The seating unit of claim 1, further comprising a backrest assembly that includes a backrest frame for carrying the backrest support over the support frame, wherein the backrest assembly is fixedly attached to the seat frame.

5. The seating unit of claim 1, further comprising a backrest assembly that reclines and inclines a backrest frame with respect to the seat assembly, wherein the backrest assembly is pivotably coupled to a rearward portion of the seat frame.

6. The seating unit of claim 5, wherein the backrest frame comprises:

a right vertical member; and a left vertical member, wherein the right and left vertical members are pivotably coupled to the rearward portion of the seat via respective pivot links.

7. The seating unit of claim 6, wherein the backrest frame comprises a lower horizontal member that spans and coupled the right and left vertical members.

8. The seating unit of claim 7, further comprising a gas piston having a rod end and a head end, wherein the gas piston pivotably inter-couples the backrest frame and the seat frame, and wherein the gas piston serves to dampen rotation about the pivotable coupling between the backrest frame and the seat frame.

9. The seating unit of claim 8, wherein the rod end of the gas piston is pivotably coupled to a mid section of the upper crossbeam of the seat assembly via a bracket.

10. The seating unit of claim 8, wherein the head end of the gas piston is pivotably coupled to a mid section of the lower horizontal member of the backrest frame via a bracket.

11. The seating unit of claim 6, wherein the backrest assembly further comprises a u-shaped adjustable-headrest link that is pivotably coupled to the right and left vertical members of the backrest frame.

12. The seating unit of claim 1, wherein the rocker mechanism comprises one or more flexible elements that interconnect the upper crossbeam of the seat assembly and the traverse plate of the support frame.

13. The seating unit of claim 1, wherein the rocker mechanism comprises one or more flexible elements that interconnect the upper crossbeam of the seat assembly and the traverse plate of the support frame.

14. The seating unit of claim 1, wherein the rocker mechanism comprises a plurality of spring plates having a front end and a back end, wherein the front end of the spring plates is connected to the traverse plate of the support frame, and wherein the back end of the spring plates is connected to the upper crossbeam of the seat assembly.

15. The seating unit of claim 1, wherein the base comprises a pedestal-type base that is rotatably coupled to a bottom surface of the one or more lower crossbeams, and wherein the rotatable coupling allows the support frame to swivel with respect to the pedestal-type base.

16. The seating unit of claim 1, wherein the base comprises a plurality of legs that extend downward from at least one armrest to meet the underlying surface, and wherein the at least one armrest is fixedly attached to at least one opposed end of the lower crossbeams of the support frame.

17. A linkage mechanism comprising:

one or more lower crossbeams that are coupled to a base of a seating unit;

a traverse plate that is fixedly attached to and extends upward from the one or more lower crossbeams;

a seat frame for carrying a seat support of the seating unit over a support frame;

seat-mounting plates that are fixedly attached to and extend downward from the seat frame;

a upper crossbeam that spans and couples the seat-mounting plates; and a plurality of flexible elements having a front end and a back end, wherein the front end of the flexible elements is connected to the traverse plate of the one or more lower crossbeams, and wherein the back end of the flexible elements is connected to the upper crossbeam of the seat assembly.

18. The linkage mechanism of claim 17, wherein the front end of the flexible elements is connected to a top surface of the traverse plate, and wherein the back end of the flexible elements is connected to a bottom surface of the upper crossbeam.

19. The linkage mechanism of claim 17, wherein the flexible elements represent fiberglass strips that are substantially evenly spaced along a length of the traverse plate.

20. A seating unit, comprising:

one or more lower crossbeams having opposed ends;

a traverse plate that is fixedly attached to and extends upward from the one or more lower crossbeams;

a plurality of flexible elements having a front end and a back end, wherein the front end of the flexible elements is connected to the traverse plate;

an upper crossbeam that includes opposed ends, wherein the upper crossbeam is connected to the back end of the flexible elements on a surface between the opposed ends;

a pair of seat-mounting plates that are fixedly attached proximately to the opposed ends of the upper crossbeam;

a seat frame fixedly attached to the seat-mounting plates, wherein the seat frame carries a seat support of the seating unit; and a pair of armrests, wherein the armrests are fixedly attached to the opposed ends, respectively, of the one or more lower crossbeams when an order specifies that the armrests are to remain motionless upon an occupant of the seating unit rocking the seat frame fore and aft with respect to the one or more lower crossbeams using the flexible elements; or wherein the armrests are fixedly attached to the opposed ends, respectively, of the upper crossbeam when the order specifies that the armrests are to sway upon the occupant of the seating unit rocking the seat frame fore and aft with respect to the one or more lower crossbeams using the flexible elements.

* * * * *